US009401238B2

(12) United States Patent
Mimura et al.

(10) Patent No.: US 9,401,238 B2
(45) Date of Patent: Jul. 26, 2016

(54) COIL TERMINAL AND ELECTROMAGNETIC RELAY

(71) Applicant: OMRON Corporation, Kyoto-shi, Kyoto (JP)

(72) Inventors: Yoshiaki Mimura, Kumamoto (JP); Hironori Sanada, Kumamoto (JP); Hideto Yamauchi, Kumamoto (JP); Akira Tsurusaki, Kumamoto (JP); Shintaro Wada, Kumamoto (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/589,549

(22) Filed: Jan. 5, 2015

(65) Prior Publication Data

US 2015/0262743 A1 Sep. 17, 2015

(30) Foreign Application Priority Data

Mar. 14, 2014 (JP) ..... 2014-052381

(51) Int. Cl.
*H01F 5/04* (2006.01)
*H01H 49/00* (2006.01)
*H01H 50/44* (2006.01)

(52) U.S. Cl.
CPC ..... *H01F 5/04* (2013.01); *H01H 49/00* (2013.01); *H01H 50/443* (2013.01)

(58) Field of Classification Search
CPC ..... H01H 50/443; H01H 49/00; H01F 5/04
See application file for complete search history.

(56) References Cited

U.S. PATENT DOCUMENTS

| | | | | | |
|---|---|---|---|---|---|
| 1,805,638 | A * | 5/1931 | Scofield | H01F 5/04 | 336/192 |
| 4,166,265 | A * | 8/1979 | Reynolds | H01F 5/04 | 29/605 |
| 4,258,973 | A * | 3/1981 | Reynolds | H01F 5/04 | 439/391 |
| 6,198,064 | B1 * | 3/2001 | Fujiwara | H01R 4/029 | 219/56.21 |
| 6,483,407 | B1 | 11/2002 | Matsuda et al. | | |

FOREIGN PATENT DOCUMENTS

| | | | | |
|---|---|---|---|---|
| IT | GB 2250864 A * | 6/1992 | H01F 5/04 | |
| JP | S55-71005 A | 5/1980 | | |
| JP | H05-54948 A | 3/1993 | | |
| JP | 2000-260284 A | 9/2000 | | |
| WO | 2014/038499 A1 | 3/2014 | | |

OTHER PUBLICATIONS

Extended European Search Report issued in EP Application No. 14200535.4, mailed on Jul. 14, 2015 (5 pages).

* cited by examiner

*Primary Examiner* — Mohamad Musleh
(74) *Attorney, Agent, or Firm* — Osha Liang LLP

(57) ABSTRACT

A coil terminal has a winding section comprising an end of coiled wire wound therearound. The winding section is bent relative to a remaining section of the coil terminal. The winding section has a proximal wire engagement portion and a distal wire engagement portion spaced away from each other in a longitudinal direction of the winding section, and an intermediate region disposed between the proximal wire engagement portion and the distal wire engagement portion. The wire end is extended in the intermediate region without being wound around the intermediate region.

12 Claims, 7 Drawing Sheets

COIL TERMINAL AND ELECTROMAGNETIC RELAY

BACKGROUND

1. Technical Field

The invention relates to a coil terminal and an electromagnetic relay including the coil terminal.

2. Related Art

Conventionally, there has been disclosed an electromagnetic relay in, for example, JP 2000-260284(A), which comprises a spool 2, a coil of wire 2*a* wound around the spool 2, and coil terminals 12 and 13 around which opposite ends of the coil are wound or tangled.

In this electromagnetic relay, the tangled ends of the coil 2*c* are soldered to respective wire connecting portions 32*a* and 33*a* of the terminals 12 and 13 which are then bent upward by typically forcing the solder portions using a dedicated jig or tool, without damaging extended portions of the wire.

With the recent trend of miniaturization of the electromagnetic relay devices, it becomes difficult for the bending tool to force only small soldered portions of the terminals and there is an increased likelihood that the bending jig will force and damage and, as a result, break the extended portions of the wire at the bending of the coil terminals 12 and 13.

SUMMARY

Accordingly, one or more embodiments of the present invention is to provide a coil terminal which prevents the breaking likelihood of the extended portions of the wire at the bending of the coil terminals by the bending jig and to provide an electromagnetic relay incorporating the coil terminals.

A coil terminal according to one or more embodiments of the invention comprises a winding section around which is configured so that an end of coiled wire is wound around the winding section and then the winding section is bent relative to a remaining section of the coil terminal; the winding section having a pair of, proximal and distal wire engagement portions spaced away from each other in a longitudinal direction of the winding section, the wire end being extended in a region ranging from the proximal wire engagement portion to the distal wire engagement portions without being wound around the region.

With this arrangement of the coil terminal, at the winding of the wire end around the winding section, it is extended between the proximal and distal wire engagement portions without being wound around the region ranging between the proximal and distal wire engagement portions. This allows that the bending jig to force and bend the region without making contact with the extended wire in the region, which prevents the wire from being damaged or broken in the region.

According to one or more embodiments of the invention, a part of the wire end is wound around a distal end region positioned on and then soldered to a distal side of the distal wire engagement portion.

Accordingly, the wire wound around the distal end region is covered by the solder, preventing the bending jig from making contact with the wire wound around the region, which in turn prevents the wire in that region from being damaged or broken by the bending jig even for a small coil terminal.

According to one or more embodiments of the invention, each of the proximal and distal wire engagement portions may be a convex configuration.

Accordingly, a greater freedom is provided for the designing of the coil terminal.

According to one or more embodiments of the invention, one of the proximal and distal wire engagement portions may be a convex configuration and the other of the proximal and distal wire engagement portions may be a concave configuration.

Accordingly, a greater freedom is provided for the designing of the coil terminal.

According to one or more embodiments of the invention, each of the proximal and distal wire engagement portions may be a concave configuration.

Accordingly, a greater freedom is provided for the designing of the coil terminal.

According to one or more embodiments of the invention, the proximal and distal wire engagement portions are angularly offset from each other about a longitudinal axis of the winding section.

Accordingly, a greater freedom is provided for the designing of the coil terminal.

According to one or more embodiments of the invention, the proximal and distal wire engagement portions are positioned on opposite sides of a longitudinal axis of the winding section.

Accordingly, a greater freedom is provided for the designing of the coil terminal.

According to one or more embodiments of the invention, an electromagnetic relay comprises any one of the coil terminals.

Accordingly, the electromagnetic relay is provided which is capable of preventing the wire from being damaged or broken at the bending of the winding section by means of the bending jig or tool.

DETAILED DESCRIPTION

Figure 1:
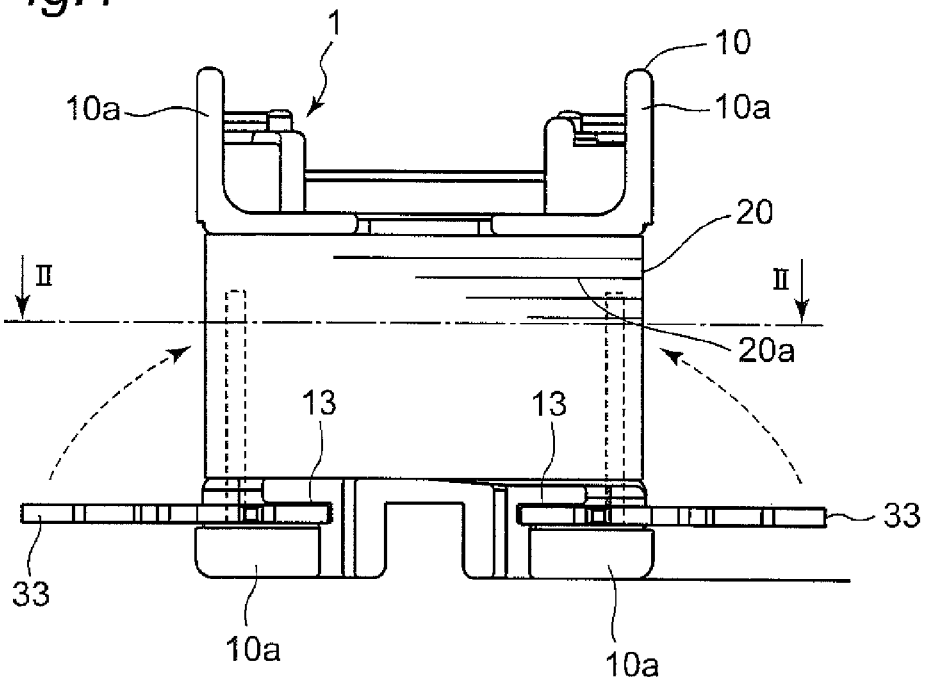
FIG. 1 is a top plan view of a coil unit in which coil terminals according to a first embodiment of the invention are assembled, showing the coil terminals before they are bent.

With reference to the accompanying drawings, embodiments of the invention will be described below. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

In the following descriptions, directional terminology such as "upper", "lower", etc., is used with reference to the orientation of the drawing(s) being described, it is used for purposes of better understanding of the invention and is in no way limiting the technical scope of the invention.

First Embodiment

Figure 2:
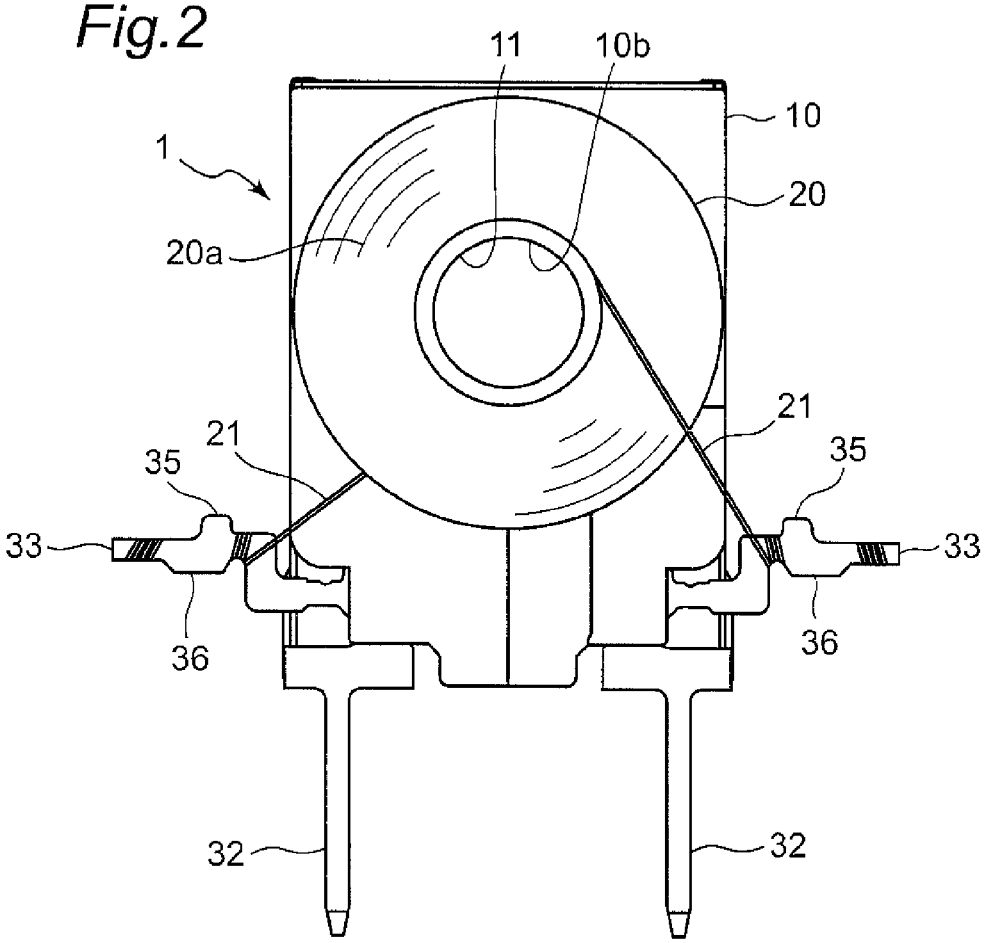
FIG. 2 is a cross sectional view of the coil unit taken along lines II-II in FIG. 1.
Figure 3:
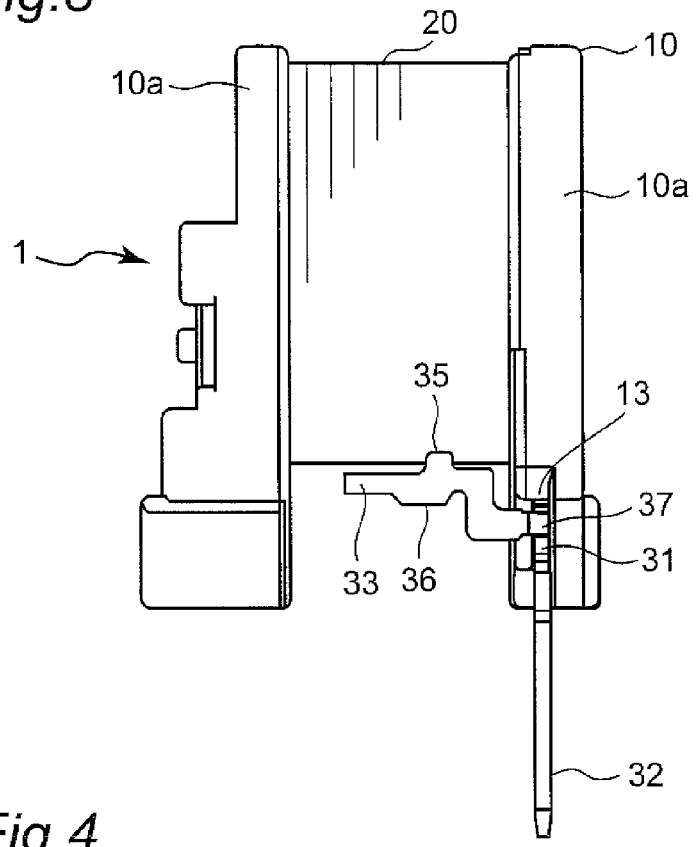
FIG. 3 is a side elevational view of the coil unit, showing coil terminals before they are bent.

As shown in FIGS. 1 to 3, a coil unit, generally indicated by reference numeral 1, in which the coil terminals according to a first embodiment of the invention are incorporated, has a spool 10 made of a cylindrical portion 10*b* and a pair of flanges 10*a* integrally mounted on opposite ends of the cylindrical portion 10*b*, and a coil 20 formed by winding a wire 20*a* around the cylindrical portion 10*b* of the spool 10. The coil unit 1 further has a pair of coil terminals 30 mounted on opposite sides of one flange 10*a*.

As shown in FIG. 2, the spool 10 has a through-hole 11 formed at substantially a center thereof and inside the cylindrical portion 10*b*. One of the flanges 10*a* of the spool 10 has a pair of grooves 13 in each of which a coil terminal 30 is press-fitted.

The opposite ends 21 of the wire 20*a* of the coil 20, wound around the spool 10, are extended out of the coil 20 and tangled and wound around respective coil terminals 30. For convenience, the extended ends 21 of the wire 20*a* are omitted from FIGS. 1 and 3.

Figure 4:
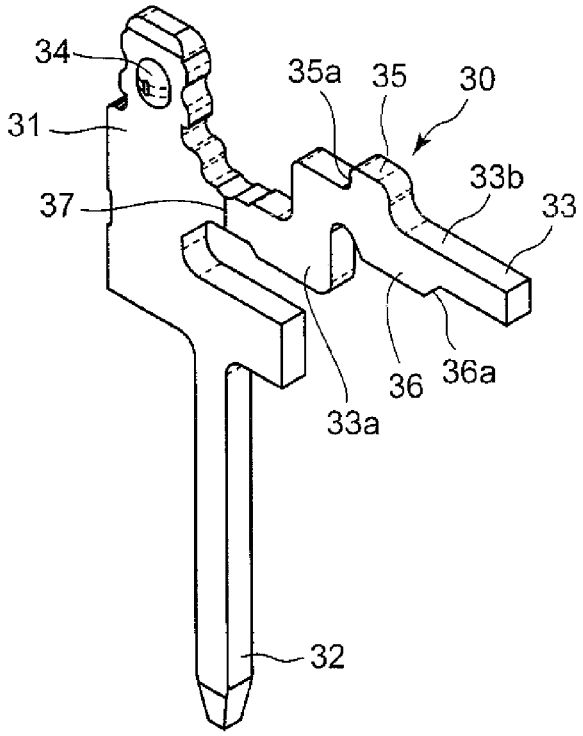
FIG. 4 is a perspective view showing the coil terminal assembled in the electromagnetic relay in FIG. 1.

As shown in FIG. 4, the coil terminal 30 has a primary section 31, a terminal section 32, and a winding section 33 formed integrally therewith.

The primary section 31 is L-shaped and has a press-fitting projection 34 for preventing the coil terminal 30 press-fitted in the groove 13 of the spool 10 from dropping therefrom.

The terminal section 32, which has a rectangular cross-section and is extended downward and linearly from the primary section 31, is press-fitted in the terminal groove not shown defined in the electromagnetic relay at the assembling of the coil unit into the electromagnetic relay.

The winding section 33, which has a rectangular cross-section and is extended laterally from the primary section 31, has a double-angled, proximal section 33*a* made of a pair of vertically shifted horizontal portions and a vertical portion connecting between the horizontal portions, and a straight portion 33*b* extending from the proximal section 33*a*. The proximal section 33*a* has a thinned portion 37, provided adjacent the primary section 31, where it is bent relative to the primary portion as shown in FIG. 1. Also, the straight portion 33*b* has upper and lower projections 35 and 36 defined on opposite sides with respect to the longitudinal axis of the winding section 33, i.e., integrally on the upper and lower surfaces thereof, respectively. The upper and lower projections 35 and 36 are laterally shifted from each other so that they constitute a pair of spaced wire engagement portions.

Next, discussions will be made to an assembling of the coil unit.

The coil terminals 30 are each press-fitted in the grooves 13 of the spool 10 so that they oppose to each other. Then, the ends of the wire 20*a* extended from the coil 20 are wound and tangled around the winding sections of the coil terminals 30.

Figure 5:
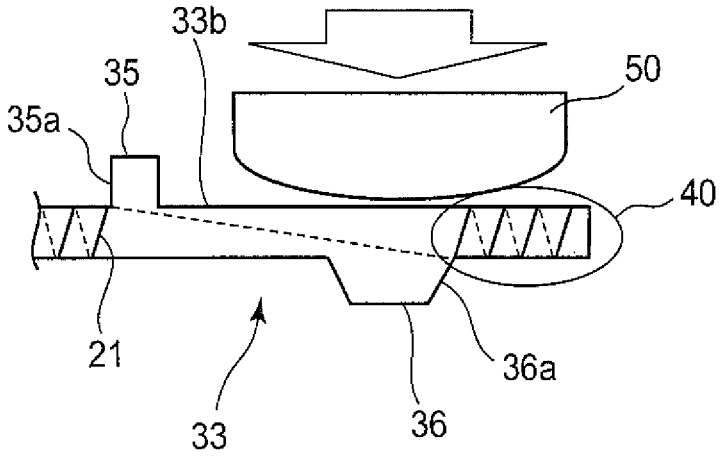
FIG. 5 is a schematic view showing that the coil terminal is being forced and bent by a bending jig or tool.
Figure 6:
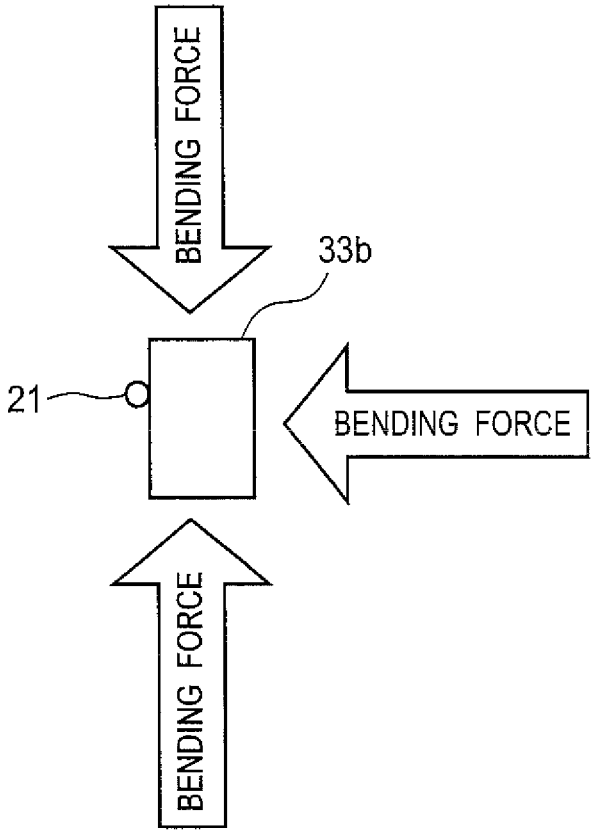
FIG. 6 is a schematic view showing forces applied to the coil terminal.

In this process, as shown in FIG. 5, each extended end 21 of the wire 20*a* is wound and tangled around a region of the proximal section 33*a*, positioned on the proximal side of the upper projection 35. Next, the wire end 21 is extended distally along the side surface of the winding section 33 from the proximal end engaging surface 35*a* of the upper projection 35 to the distal end engaging surface 36*a* of the lower projection 36 and then wound and tangled around a distal region of the winding section 33, positioned adjacent and on the distal side of the lower projection 36.

Subsequently, the portion of the wire 20*a* wound around the distal region of the winding section 33 is soldered to the coil terminal 30. For example, the soldering covers a region ranging from the distal end engaging surface 36*a* of the lower projection 36 to the distal tip end of the winding section 33.

Next, as shown in FIG. 1, the winding section 33 is bent by a bending jig 50 from a position illustrated in solid lines to a position illustrated in dashed lines (illustrated in solid lines in FIG. 3).

Specifically, as shown in FIG. 5, in this bending the winding section 33 is forced by the jig 50 at the region between the upper and lower projections 35 and 36 and at the distal region covered by the solder 40.

As such, in the process of winding the wire end 21 around the winding section 33, the wire end 21 is extended from the proximal end engaging surface 35*a* of the upper projection 35 to the distal end engaging surface 36*a* of the lower projection 36, without being wound therearound. This prevents the wire portion extending between the projections 35 and 36 from being forced by the jig 50 and, as a result, from breaking during the bending of the winding section 33.

Also, the soldering covers the portion of the wire 20*a* wound around the region ranging from the distal end engaging surface 36*a* of the lower projection 36 to the distal end of the winding section 33, which allows the jig to force and bend the winding section 33 without making any contact with the wire.

As described above, according to the first embodiment, a breaking of the wire 20*a* is reliably prevented because the jig 50 forces the winding section 33 without making any contact with the wire 20*a*.

Other Embodiments

Figure 7:
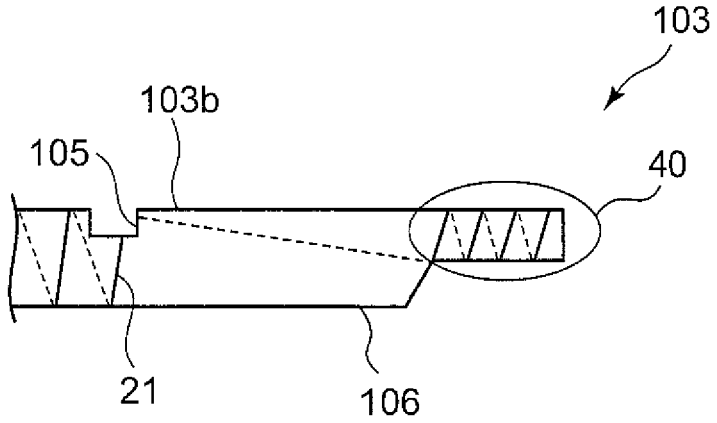
FIG. 7 is a schematic view showing a coil terminal according to a second embodiment of the invention.
Figure 8:
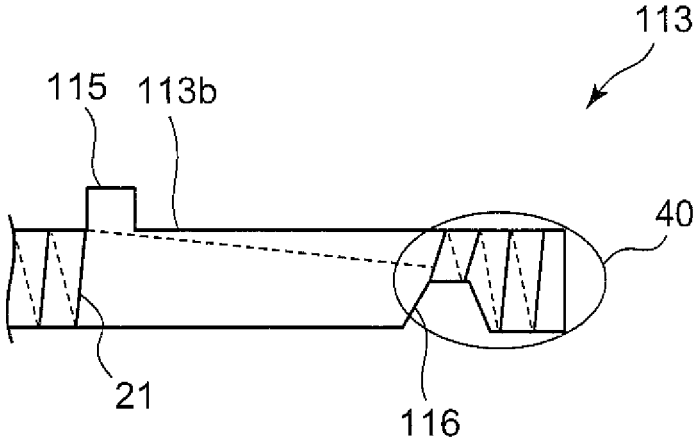
FIG. 8 is a schematic view showing a coil terminal according to a third embodiment of the invention.
Figure 9:
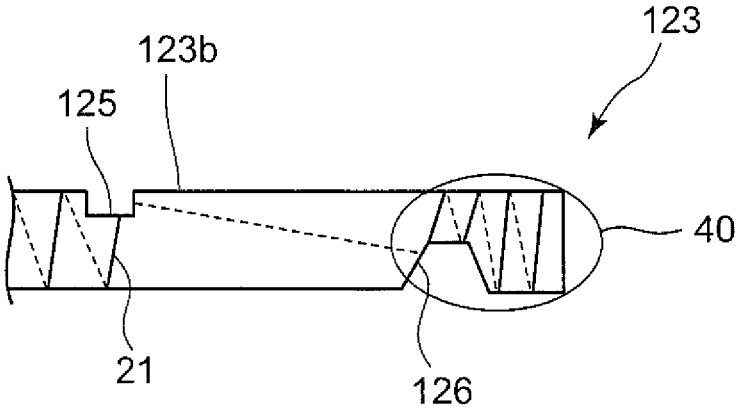
FIG. 9 is a schematic view showing a coil terminal according to a fourth embodiment of the invention.

Although the paired wire engagement portions are constituted by the upper and lower projections 35 and 36 in the first embodiment, they may be formed in different manner. For example, in the second embodiment shown in FIG. 7 the wire engagement portions are provided by forming a concave portion 105 and a convex projection 106 on the opposite, respective surfaces of the straight portion 103. Alternately, in the third embodiment shown in FIG. 8 the wire engagement portions are provided by forming a convex portion 115 and a concave portion 116 on the opposite respective surfaces of the straight portion 113. Alternatively, in the fourth embodiment shown in FIG. 9 the wire engagement portions are provided by forming convex portions 125 and 126 on the opposite respective surfaces of the straight portion 123. As described above, the engagement portions may be convex portions or concave portions, or they may be convex and concave portions.

Figure 10:
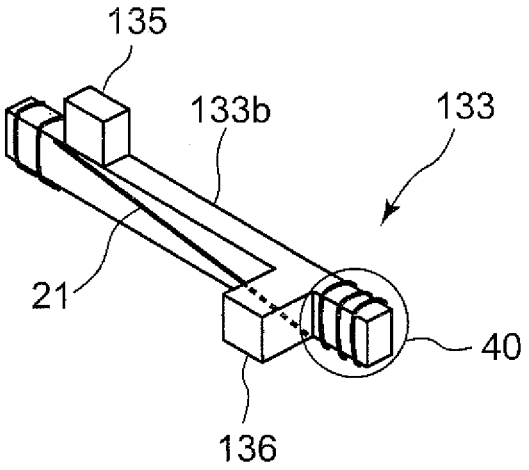
FIG. 10 is a schematic view showing a coil terminal according to a fifth embodiment of the invention.
Figure 11:
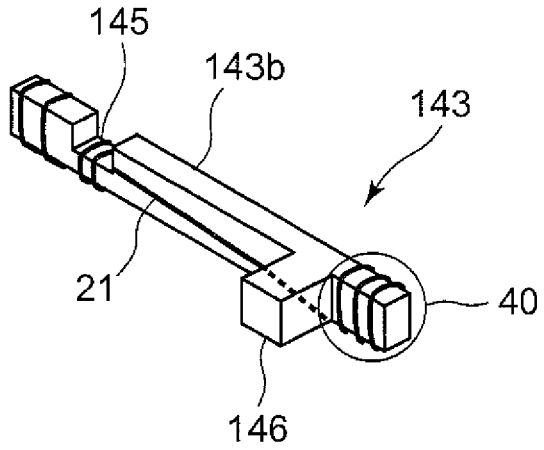
FIG. 11 is a schematic view showing a coil terminal according to a sixth embodiment of the invention.
Figure 12:
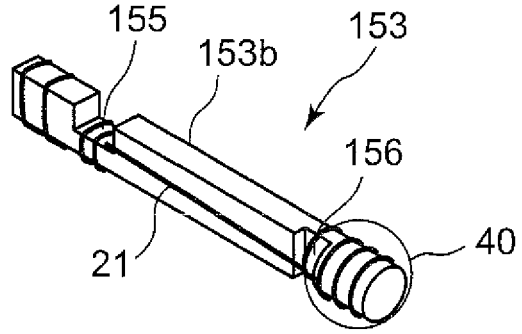
FIG. 12 is a schematic view showing a coil terminal according to a seventh embodiment of the invention.

Although in the first embodiment the engagement portions, i.e., the projections 35 and 36, are formed on opposite sides of the longitudinal axis of the winding section 33, i.e, upper and lower surfaces of the winding section 33, they may be provided in different manner. For example, in the fifth embodiment shown in in FIG. 10 the engagement portions are provided by forming projections 135 and 136 on the neighborhood surfaces of the straight portion 133*b* of the winding section 133 so that they extend in respective, orthogonal directions relative to each other. Alternatively, in the sixth embodiment shown in FIG. 11 the wire engagement portions are provided by forming a concave portion 145 and a convex portion 146 on the neighboring respective surfaces of the straight portion 143*b* of the winding section 143. Alternatively, in the seventh embodiment shown in FIG. 12 the wire engagement portions are provided by forming concave portions 155 and 156 on the neighboring respective surfaces of the straight portion 153*b* of the winding section 153. As described above, the engagement portions may be provided on the angularly shifted positions around the longitudinal axis of the winding section.

Figure 13:
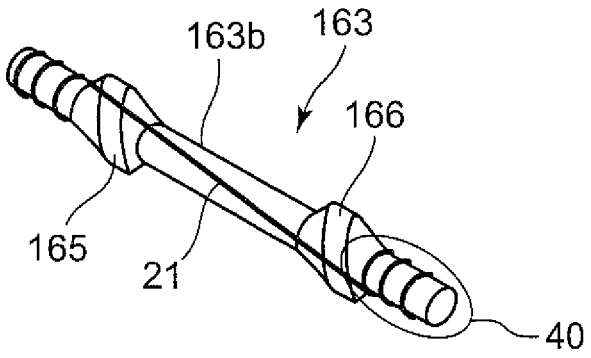
FIG. 13 is a schematic view showing a coil terminal according to an eighth embodiment of the invention.
Figure 14:
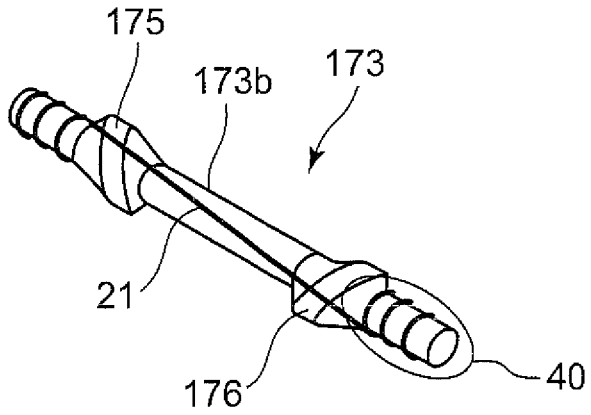
FIG. 14 is a schematic view showing a coil terminal according to a ninth embodiment of the invention.

Also, in the eighth embodiment shown in FIG. 13 the engagement portions are provided by forming projections 165 and 166, on the straight portion 163*b* of the winding section 163, each having substantially triangle cross sections aligned on the longitudinal axis of winding section 153. Alternatively, in the ninth embodiment shown in FIG. 14 the engagement portions are provided by forming substantially triangle cross-section projections 175 and 176 so that they are oriented in different, orthogonal directions.

As described above, the paired engagement portions may take any configuration and position provided that the wire ends 21 can be engaged thereon and extended therebetween.

The distance between the paired engagement portions can be determined in accordance with the design requirements of the electromagnetic relay including the coil terminals provided that a space is secured for the winding portion to be forced without making any contact between the bending jig and the wire.

One or more embodiments of the present invention may be applied to any coil terminal with a winding section and a pair of wire engagement portions formed thereon. Also, the coil terminal may be modified or redesigned in accordance with the design requirements of the electromagnetic relay including the coil terminal.

The coil terminals described in the first to ninth embodiments are not limited to a terminal for making an electrical connection with another element such as a relay terminal for making an electrical connection with a component provided in the same device.

Each of the structural components of the coil terminals in the first to ninth embodiment may be replaced with another, similar component in a different embodiment or may be added to a different embodiment.

Each of the coil terminals in the first to ninth embodiments may be incorporated in any electromagnetic relay.

The coil terminal according to one or more embodiments of the invention may be incorporated not only in the above-described coil unit but also in another coil unit. Also, the coil terminal according to one or more embodiments of the invention may be incorporated in any electromagnetic relay.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

PARTS LIST

10: spool
10*a*: flange
11: through-hole
20: coil
21: wire end
30: coil terminal
32: terminal section
33, 103, 113, 123, 133, 143, 153, 163, 173: winding section
33*a*: proximal section
33*b*, 103*b*, 113*b*, 123*b*, 133*b*, 143*b*, 153*b*, 163*b*, 173*b*: straight portion
34: press-fitting projection
35, 115, 135, 136, 146, 165, 166, 175, 176: projection
35*a*: end surface
36, 106: projection
36*a*: end surface
37: thinned portion
40: solder
50: jig
105, 116, 125, 126, 145, 155, 156: concave portion

What is claimed is:

1. An electromagnetic relay comprising:
a coiled wire having opposite ends; and
a pair of coil terminals having respective winding sections connected with the opposite wire ends;
wherein the winding sections are bent relative to remaining sections of the coil terminals so that an insulation distance between the coil terminals is maintained constant before and after bending the winding sections;
wherein each of the winding sections comprises a proximal wire engagement portion and a distal wire engagement portion spaced away from each other in a longitudinal direction of the winding section, and an intermediate region disposed between the proximal wire engagement portion and the distal wire engagement portion, and
wherein each of the wire ends is extended in the intermediate region without being wound around the intermediate region.

2. The electromagnetic relay of claim 1, wherein a part of the wire end is wound around and then soldered to a distal region of the distal wire engagement portion.

3. The electromagnetic relay of claim 1, wherein each of the proximal and distal wire engagement portions has a convex configuration.

4. The electromagnetic relay of claim 1, wherein one of the proximal and distal wire engagement portions has a convex configuration and the other of the proximal and distal wire engagement portions has a concave configuration.

5. The electromagnetic relay of claim 1, wherein each of the proximal and distal wire engagement portions has a concave configuration.

6. The electromagnetic relay of claim 1, wherein the proximal and distal wire engagement portions are angularly offset from each other about a longitudinal axis of the winding section.

7. The electromagnetic relay of claim 1, wherein the proximal and distal wire engagement portions are positioned on opposite sides of a longitudinal axis of the winding section.

8. The electromagnetic relay of claim 2, wherein each of the proximal and distal wire engagement portions has a convex configuration.

9. The electromagnetic relay of claim 2, wherein one of the proximal and distal wire engagement portions has a convex configuration and the other of the proximal and distal wire engagement portions has a concave configuration.

10. The electromagnetic relay of claim 2, wherein each of the proximal and distal wire engagement portions has a concave configuration.

11. The electromagnetic relay of claim 2, wherein the proximal and distal wire engagement portions are angularly offset from each other about a longitudinal axis of the winding section.

12. The electromagnetic relay of claim 2, wherein the proximal and distal wire engagement portions are positioned on opposite sides of a longitudinal axis of the winding section.

* * * * *